US005660447A

United States Patent [19]

Angelici

[11] Patent Number: 5,660,447

[45] Date of Patent: Aug. 26, 1997

[54] WHEEL FOR IN-LINE ROLLER SKATES

[75] Inventor: Adolfo Angelici, Montalto Marche, Israel

[73] Assignee: Alfaplastic SRL, Cassola, Italy

[21] Appl. No.: 512,219

[22] Filed: Aug. 7, 1995

[30] Foreign Application Priority Data

Aug. 10, 1994 [IT] Italy ..... VI94A0127

[51] Int. Cl.[6] ..... B60B 5/02; A63C 17/22

[52] U.S. Cl. ..... 301/5.7; 280/11.22; 152/323; 264/163

[58] Field of Search ..... 301/5.3, 5.7, 64.7; 280/11.22, 11.23; 152/323, 393, 394; 264/163, 254, 138

[56] References Cited

U.S. PATENT DOCUMENTS 2,559,118 7/1951 Foran .
4,447,093 5/1984 Cunard et al. .
4,909,523 3/1990 Olson .
5,028,058 7/1991 Olson ..... 280/11.22
5,310,250 5/1994 Gonsior .
5,320,418 6/1994 Chen .
5,478,140 12/1995 Racosky .
5,513,861 5/1996 Monroy et al. .

*Primary Examiner*—David M. Mitchell
*Assistant Examiner*—Hoa B. Trinh
*Attorney, Agent, or Firm*—Watson Cole Stevens Davis, P.L.L.C.

[57] ABSTRACT

A wheel for an in-line roller skate of the type having aligned wheels, wherein a hub has an axial hole within which there are receptacles for ball bearings and a supporting pivot. One or two rings concentric with the hole form a support for a moldable tire which is molded onto the hub. The outer concentric ring has a plurality of thin annular sections and transverse openings to define an annular space between each of the annular sections and the ring connected by the transversal openings. The annular spaces and the transverse openings are filled with the material forming the tire to secure the same to the hub.

6 Claims, 3 Drawing Sheets

WHEEL FOR IN-LINE ROLLER SKATES

BACKGROUND OF THE INVENTION

1. Field of the Invention

The invention concerns a wheel for in-line roller skates namely the type having aligned or in-line wheels, which has a special configuration of its tire rim or hub so as to permit a reinforced grip of the toroidal cover of the wheel tread or tire which is directly in contact with the ground.

2. General State of the Art

It is known that in roller skates having aligned wheels, the wheels undergo violent stresses, especially when such roller skates am used on roads rather than on skating rings having smooth surfaces especially built for this purpose.

The stresses to the wheels are caused both by the irregular surface of the road and by the stresses which are encountered during the rotation of the wheels on the sliding surface. In addition, such wheels hardly rotate with their axis parallel to the roadway but they very often have a slanted axis in relation to the roadway and, therefore, the impact reaction which is discharged on the tire, tends to tear the tire from the hub.

It is also known that the tire or tread cover, which has a toroidal shape, is made of plastic material, usually thermosetting polyurethane, the chemical characteristics of which do not have an affinity with the plastic material forming the tire rim or hub to which the tire clings. The hub is usually made of polyamide or of another material which does not mix or melt with the polyurethane material.

Thus, as a result of the stresses the wheels undergo when the roller skates are used, it is impossible to closely combine together the materials forming the tire and the hub. It therefore is of primary importance to obtain some anchorage points between the tire and the hub which is sufficient to prevent such separation.

A hub or tire rim for wheels of roller skates shown in U.S. Pat. No. 5,028,058, has two rings concentric with the wheel pivot opening or hole. The rings have an increasing diameter and are connected with the hole through essentially radial sectors. The outer ring is covered by the casting of polyurethane material of the tire and extends to the transversal openings between the outer and inner concentric ring, so as to form transversal segments of cast material. The segments hold the tire to the more external ring of the hub.

Experience has shown that this type of anchorage does not prevent the wheel from becoming damaged by the shocks and by the strong transversal stresses. As a result, the transversal segments become cut and the tread eventually rotates freely on the hub with evident damage to the skate and danger to the user of the roller skate.

SUMMARY OF THE INVENTION

It is an object of the invention to increase the degree of anchorage between the tire and the hub so as to maintain as long as possible the integrity of the wheels.

Another object is to prevent rotation of the tire on the hub even when the transversal points penetrating into the tire hub are broken.

Another object of the invention is to cause discharge of the reaction forces of the ground against the wheel to occur on surfaces as nearly perpendicular as possible to the direction of the reaction force, even when the roller skate is slanted in relation to the contact surface. This in order to reduce the cutting component of the forces which act on the tire.

All the above mentioned purposes and others, will become apparent hereafter are achieved by a wheel for roller skates having aligned wheels mounted on supporting pivots, which comprises:

a hub made of plastic material and having an essentially cylindrical shape formed with a wall having a cylindrical hole having at least one receptacle for receiving ball bearings which engage the supporting pivot for said wheel;

at least one ring concentric with said hole, having an increasing diameter and relatively narrow radial web portions connecting the at least one ring and the wall of said hole, said radial web portions formed with a plurality of transversal openings;

a tire formed by molding onto said hub of a material suited to the rolling of said wheel on a contact surface of the roller skate, wherein the at least one ring extending transversely of the web portions forming a plurality of relatively thin annular sections being equally spaced from one another, each of said annular sections being connected to the ring of said rim, so as to define an annular space between each said annular section and said ring, and being filled with the tire material thereby shaping two rings connected with each other by the transversal segments formed by the material molded into each annular section.

The invention discloses a reinforced grip wherein the tire has two rings facing each other and inserted underneath the plurality of round sections connected together by a series of transverse openings which connect said two rings, so that the anchorage of the toroid tread resembles a cage formed by the two rings and by the transversal sections uniting said rings and corresponding with the interruptions between the annular sections which form the hub according to the invention.

According to a particular embodiment of the invention, an innermost ring of the hub in relation to the hole extends on one side beyond the width of the wheel, so as to form a cylindrical wall which protects the inner parts of the rim, while the outer parts of the same are covered with the melted tire material.

Further scope of applicability of the present invention will become apparent from the detailed description given hereinafter.

BRIEF DESCRIPTION OF THE DRAWINGS

It should be understood that the detailed description and specific examples, while indicating preferred embodiments of the invention, are given by way of illustration only. Various changes and modifications within the spirit and scope of the invention will become apparent to those skilled in the art from this detailed description and from the drawings, wherein.

DESCRIPTION OF THE PREFERRED EMBODIMENT

Figure 1:
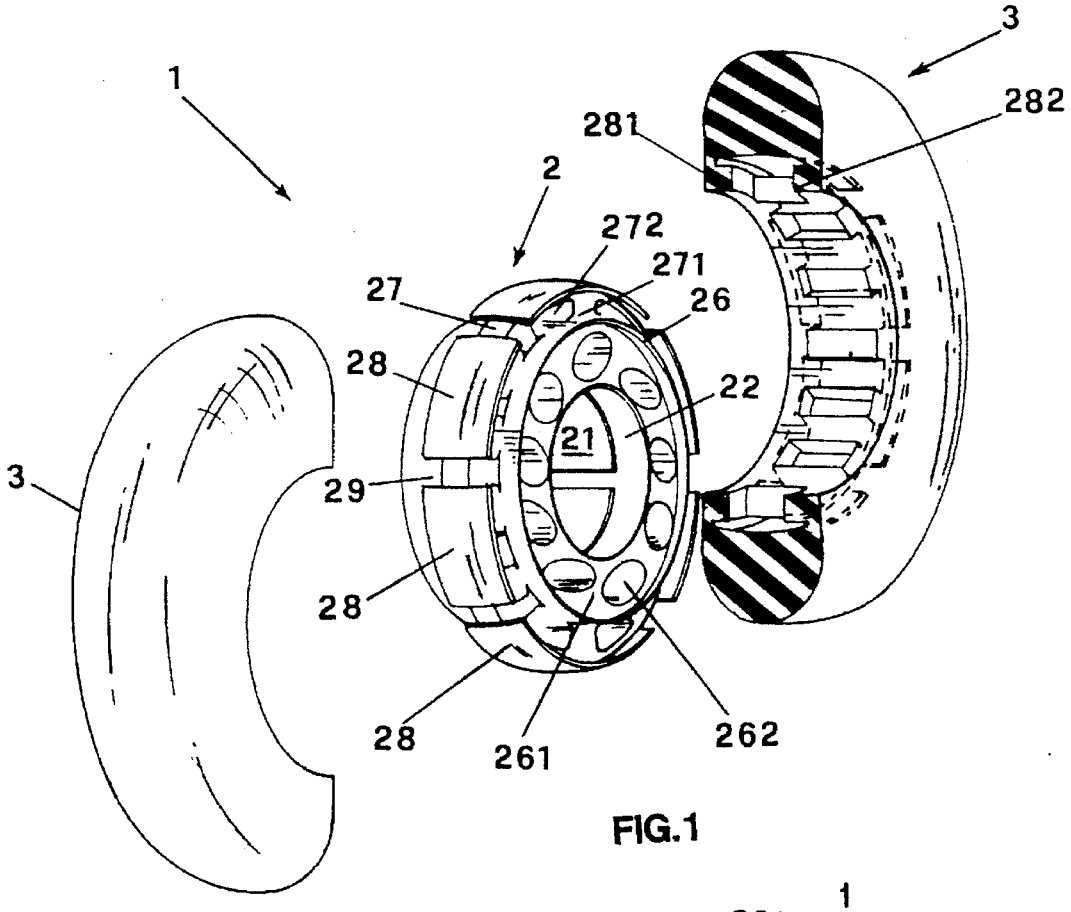
FIG. 1 is a perspective and exploded view of an exemplary embodiment of the wheel showing the hub and tire separated from the hub.
Figure 2:
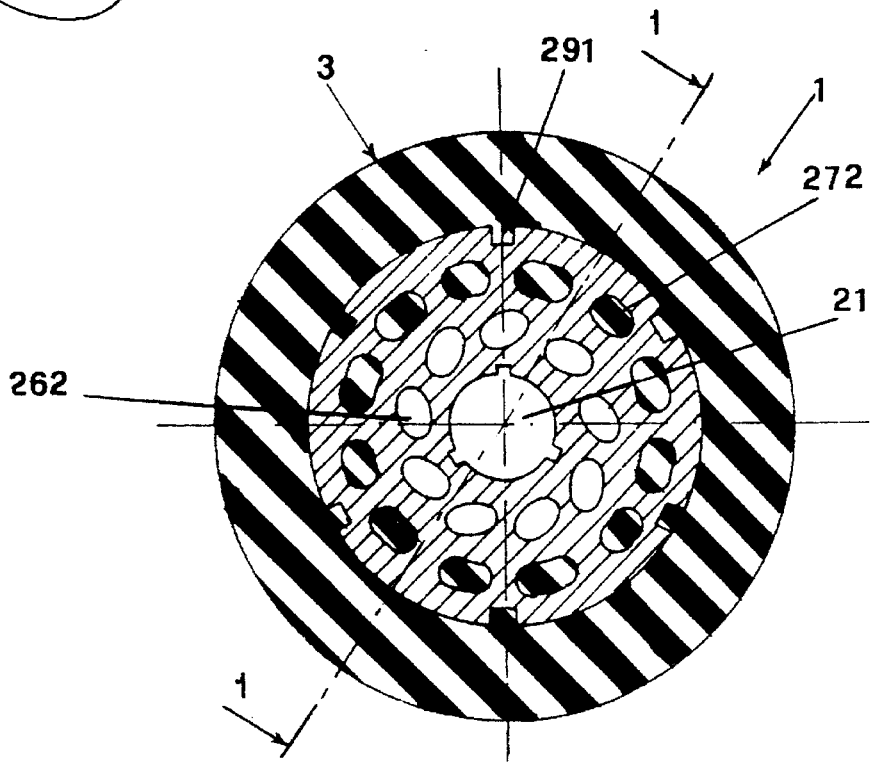
FIG. 2 is a section of FIG. 1 along a plane perpendicular to the axis of the wheel.

With reference to the FIGS. 1 and 2, it can be observed that the wheel 1 according to the invention has a rim or hub 2 made of plastic material, for instance polyamide, and a toroid cover or tire 3, wrapping the hub. The tire 3 has an outer surface constituting the in contact with the rolling surface of the roller skate. The tread tire 3 is generally made of thermosetting polyurethane.

The hub 2 has wall portions formed with a central hole 21 with two opposite receptacles 22 and 23 for receiving pivot 4 around which wheel 1 turns. Said hub 2 has two rings concentric with said hole 21, indicated with 26 and 27 and having diameters 21 differing from and increasing in relation to the diameter of the hole 22. Said concentric rings 26 and 27 are each connected with the outer wall of hole 21 through essentially radial sections 261 and 271 respectively, which define openings 262 and 272 arranged transversely in relation to the ideal plane of the wheel and are, therefore, parallel to the axis of hole 21 and distributed at equal distances around circumferentially. The inner ring 26, as can be observed in FIG. 3, has larger dimensions when compared with ring 27. On the outer surface of ring 27 there are also a series of relatively thin annular sections 28 (see FIG. 1) which have a greater width than that of ring 27. Said annular sections 28 are spaced apart from one another by a space 29, which, as will be seen later, is used to receive transversal segments made of the same material forming the tire, so as to prevent the rolling of the tire, should the anchorage between the hub and the tire break.

Each annular section 28 has a curved outer surface 285 having an outwardly facing convex surface corresponding with the convex surface of the tire, so that the reaction forces which develop while the wheel is turning, even when it is in a slanted position, have their major force component approximately perpendicular to the tangent passing through 10 the point of intersection between surface 285 and the line of action of said force component.

According to the known technique, the tire is cast by melting bi-component, thermosetting polyurethane into a die wherein hub 2 has previously been inserted with the axis of the wheel arranged in the vertical position.

Figure 3:
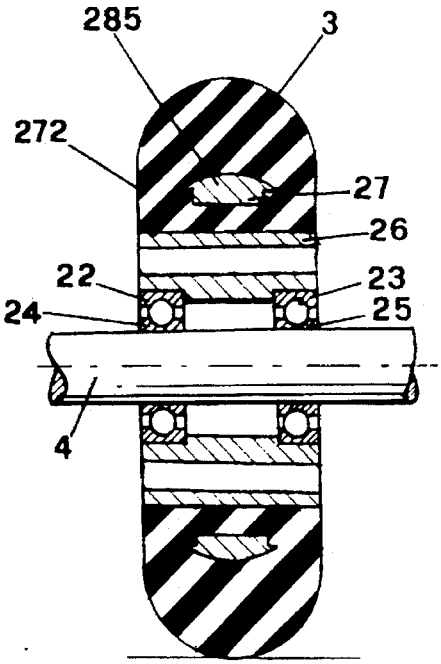
FIG. 3 is a section of the wheel of FIG. 2 along the plane of section I—I.

As can be appreciated from the FIGS 1, 2 and 3, when the tire 3 is formed, the polyurethane material penetrates into the transversal cavities 272, into the interspaces 29, which separate one annular section 28 from the next, and underneath the annular section 28. As can clearly be seen in the exploded view of FIG. 1, the rings 281 and 282 are made of the same material as the tire 3. It is clear that the rings 281 and 282, the transversal sections penetrating into the cavities 272 and also the transversal sections 291 which penetrate into the interspaces 29 between the annular sections 28, together form a sort of cage which withstands the stresses of the tire and particularly the cutting forces against the tire 3. The increase in the resistance to the breaking forces and to tears of the tire in relation to the hub is due both to the presence of the transversal sections of polyurethane material in the holes 272 and to the presence of the rings of the same material 281 and 282 which are arranged underneath the wings of the annular sections 28.

Moreover, as has been said, the material filling the cavities 29 between one section 28 and the next makes it possible for the tire 3 not to turn in relation to hub 2 and not to come away from the same, even if the transversal sections within the spaces 272 are torn.

Figure 4:
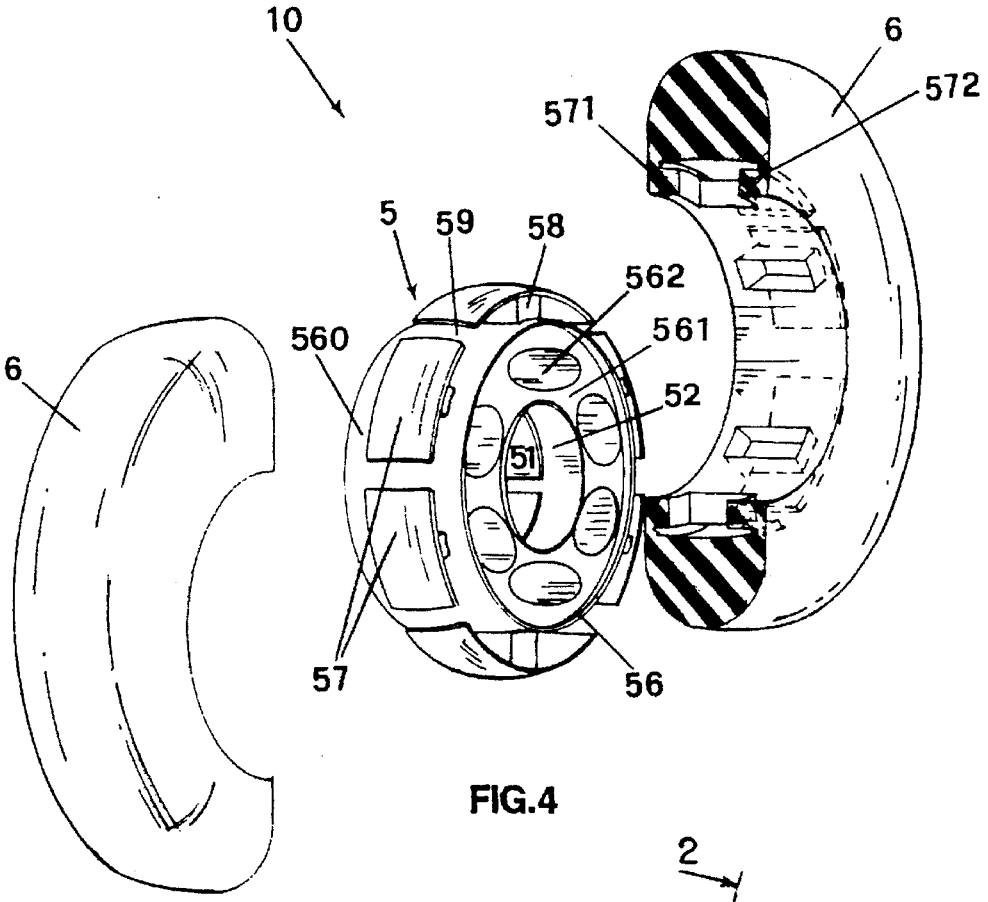
FIG. 4 is a perspective and exploded view of a different embodiment of the invention.
Figure 5:
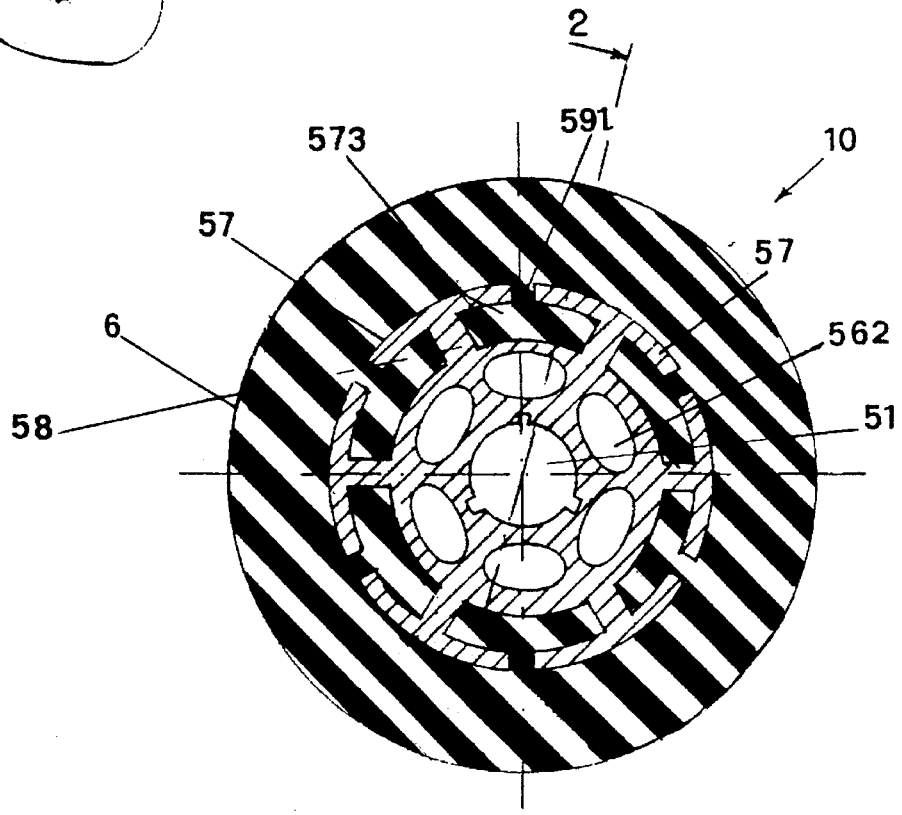
FIG. 5 is a section of the wheel of FIG. 4 along a plane perpendicular to the axis of said wheel.

FIG. 4 shows a different embodiment of the wheel according to the invention, indicated as a whole with 10. According to said embodiment the rim, which is now indicated with 5, has a hole 51 for receiving pivot 60. Said hole 51 has two receptacles 52 and 53 for the ball bearings 54 and 55 respectively. In the hub of FIG. 5 there is a single ring 56 concentric with hole 51 and connected with it through the radial sections 561. Said sections define the transversal openings 562 distributed around the circumference. On the outer surface 560 of ring 56 there are a plurality of annular sections 57 distributed at an equal distance from each other and connected with ring 56 by means of the transversal supports 58. Said supports have a smaller width than the annular section 57. Each of said annular sections 57 has an outer curved and convex surface 571, so that they withstand and discharge with better efficiency the components of the stresses which are discharged through the tire 6 on the annular sections 57. The tire 6 is made by melting the polyurethane material, covering the surface 560 of ring 56 and filling the annular sections 57. It is easy to understand that, because of the shape of the annular sections, the melted material acquires the shape of the rings 571 and 572 underneath the annular sections 57 and new transversal sections 573 are also shaped between two wings 32 of the material of the annular section 57, as can be seen in FIG. 5.

Thus the tire 6 is anchored not only through the rings of polyurethane material 571 and 572, but also through a series of transversal sections 573 which are connected with the outer side of tire 6 by means of the part of material 591 inserted into the cavities 59 which constitute the interspaces between the annular sections 28.

Figure 6:
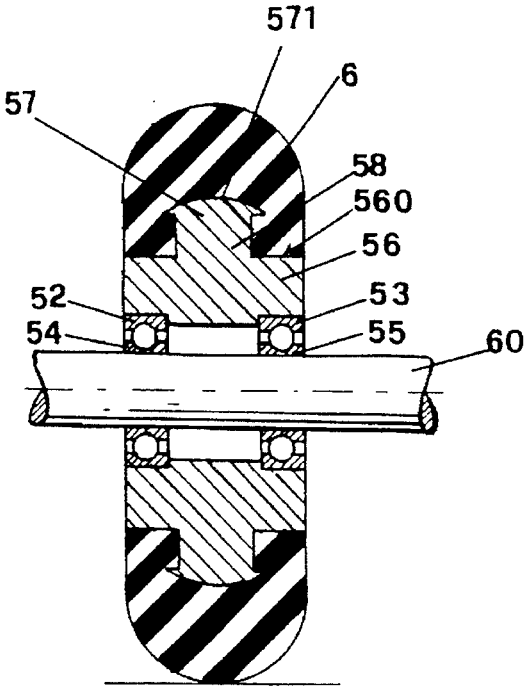
FIG. 6 is a section of the wheel of FIG. 5 along a plane of section II—II.

It is easy to understand that in the embodiment shown in the FIGS. 4, 5 and 6, the wheel according to the invention is well anchored to hub 5 and that the complete breaking of all the anchoring points between the tread and the rim becomes virtually impossible.

It will be pointed out that the presence of the cavities 59 between the annular sections of wheel 10 and the cavities 29 in wheel I allows the discharge of the air during the casting process of the polyurethane material. Thus the formation of air bubbles within the tire, which would compromise its resistance, is avoided.

Figure 7:
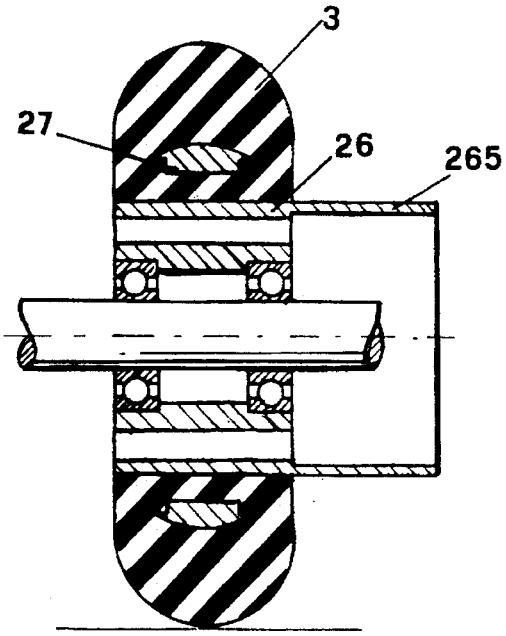
FIG. 7 shows another embodiment of the wheel similar to the wheel of FIG. 1.
Figure 8:
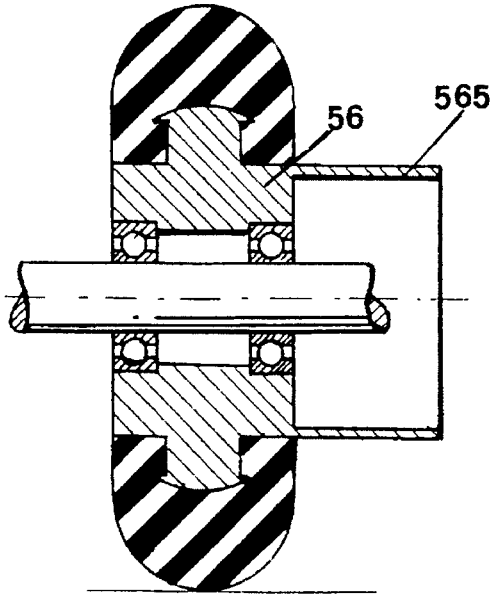
FIG. 8 shows another embodiment of the wheel similar to the wheel of FIG. 4.

According to another embodiment of the invention, shown in FIG. 7, the hub has a temporary cylindrical extension 265 extending beyond the width of wheel 1. The cylindrical wall 265 is used as a screen during the moulding of tread 3, in order to prevent the melted polyurethane from penetrating into the inner part of rim 2. Once the moulding has been completed and the polyurethane material has set, the extension 265 is removed, for instance, by means of a mechanical turning process, so that the finished wheel will have the aspect as represented in the section of FIG. 3.

In the same way, as far as the example of FIG. 4 is concerned, according to another embodiment of the invention, the innermost ring 56 extends from the hub forming a cylindrical extension 565 for the same purpose of protecting the inner part of the hub during the moulding operation. Said extension 565 is also removed after the moulding operation has been completed, so that the wheel acquires the shape represented in the section of FIG. 6.

We claim:

1. A wheel for an in-line roller skate of the type having aligned wheels supported by a pivot and ball bearings for rolling on a contact surface, comprising:

a cylindrical hub formed of plastic material, the hub including a cylindrical wall having an axial hole for receiving the pivot and at least one receptacle for receiving the ball bearings and a temporary removable cylindrical extension extending from a side portion of the wall to protect the hub during molding of the tire;

at least one ring extending outwardly from the wall and concentric therewith formed of radial web portions and corresponding annular sections extending laterally from said web portions to define annular spaces located at opposite sides of the web portions between the hub and the annular sections, said radial web portions formed with a plurality of transverse openings interconnecting the annular spaces; and a tire molded onto the hub formed of a moldable material for rolling on the contact surface, said tire formed with a plurality of annular rings and connections therebetween, the annular rings extending into the annular spaces and being generally equally spaced from one another and the connections extending through the transverse openings, each of said annular rings being connected through said transverse openings to the annular rings so as to secure the tire to the hub.

2. The wheel according to claim 1, wherein each annular section has an outwardly convex radially curved surface in contact with the tire.

3. The wheel according to claim 1 wherein said annular sections are molded together with the hub, outwardly of the ring and being in spaced relation with the axial hole.

4. The wheel according to claim 1 wherein the annular sections are molded together with the hub, each being connected with the ring by means of corresponding one of the radial web portions, and having a length dimension and a width dimension said length dimension being shorter than the width dimension.

5. The wheel according to claim 1 wherein the at least one ring comprises an inner ring portion and a concentric outer ring portion, the inner ring portion being formed with transverse holes.

6. The wheel according to claim 1 wherein the radial sections have a T profile in radial cross-section.

* * * * *

UNITED STATES PATENT AND TRADEMARK OFFICE

CERTIFICATE OF CORRECTION

PATENT NO. : 5,660,447
DATED : August 26, 1997
INVENTOR(S) : Adolfo Angelici

It is certified that error appears in the above-indentified patent and that said Letters Patent is hereby corrected as shown below:

On the title page, Item
[75] Inventor: Adolfo Angelici, Montalto Marche, Italy

Signed and Sealed this

Twenty-seventh Day of January, 1998

*Attest:*

*Attesting Officer*

BRUCE LEHMAN

*Commissioner of Patents and Trademarks*